United States Patent [19]

Uda et al.

[11] Patent Number: 4,482,134

[45] Date of Patent: Nov. 13, 1984

[54] APPARATUS FOR PRODUCING FINE METAL PARTICLES

[75] Inventors: Masahiro Uda, Tokyo; Satoru Ohno, Kiyose; Tutomu Hoshi, Kodaira, all of Japan

[73] Assignee: National Research Institute for Metals, Tokyo, Japan

[21] Appl. No.: 492,874

[22] Filed: May 9, 1983

[30] Foreign Application Priority Data

Dec. 17, 1981 [JP] Japan ..... 56-202568

[51] Int. Cl.[3] ..... B22F 9/00

[52] U.S. Cl. ..... 266/217; 266/207; 266/200; 425/6

[58] Field of Search ..... 266/200, 207, 217; 264/10, 8 C, 12; 425/6, 7

[56] References Cited

U.S. PATENT DOCUMENTS

| | | | |
|---|---|---|---|
| 3,275,787 | 9/1966 | Newberry | 264/10 |
| 3,966,374 | 6/1976 | Honnorat et al. | 425/7 |
| 4,009,233 | 2/1977 | Cloran et al. | 264/10 |
| 4,124,377 | 11/1978 | Larson | 75/45 C |
| 4,238,427 | 12/1980 | Chisholm | 264/7 |

*Primary Examiner*—L. Dewayne Rutledge
*Assistant Examiner*—Christopher W. Brody
*Attorney, Agent, or Firm*—Wenderoth, Lind & Ponack

[57] ABSTRACT

An apparatus for producing a particulate metal or alloy having a diameter of less than 5 microns by the reaction of a molten metal or alloy with activated hydrogen. The apparatus has (1) a metal melting hearth for melting a starting metal or alloy placed thereon and supporting the molten metal or alloy, (2) a discharge electrode positioned above, and opposite to, the metal or alloy placed on the melting hearth, (3) a closed vessel for containing the melting hearth and the discharge electrode, and (4) a gas inlet port in the wall of the closed vessel for introducing hydrogen or a hydrogen-containing gas into the vessel. The apparatus includes a device for quickly moving fine particles of the metal or alloy generated from the molten metal or alloy away from the vicinity of the molten metal by means of a current of hydrogen or a hydrogen-containing gas constituted by a suction duct for sucking a gas in the vicinity of the molten metal or alloy and withdrawing it out of the vessel and which extends into the vessel through the vessel wall and opens in the vicinity of the molten metal or alloy on the melting hearth; or a device for sending hydrogen or a hydrogen-containing gas into the closed vessel so as to form a turning flow of hydrogen or the hydrogen-containing gas moving downwardly from above the molten metal on the melting hearth or upwardly from below the molten metal. The improved apparatus also includes a trap for collecting the fine metal particles connected to the suction duct, a gas outlet or a gas passage, and a gas cooler provided upstream of the trap. The apparatus of this invention makes possible the production of fine particles of a metal or alloy having a narrow particle size distribution with a high recovery ratio.

8 Claims, 5 Drawing Figures

FIG. 3
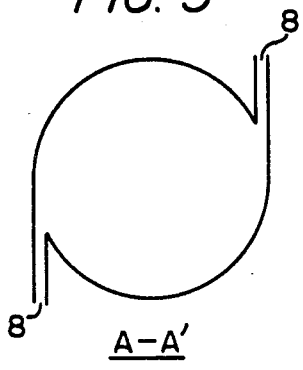
FIG. 4
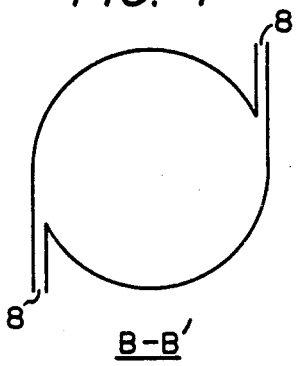
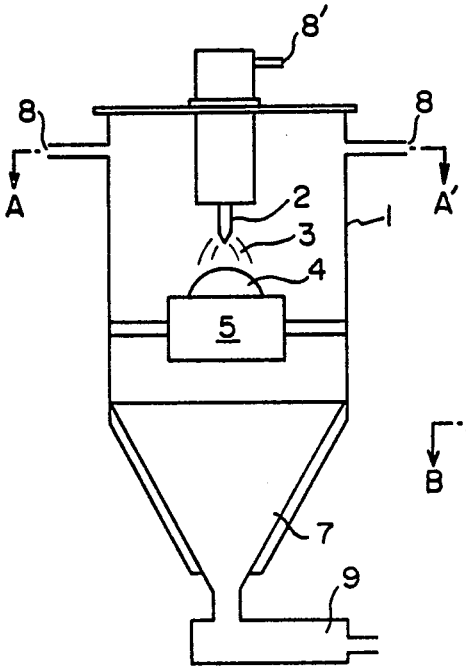
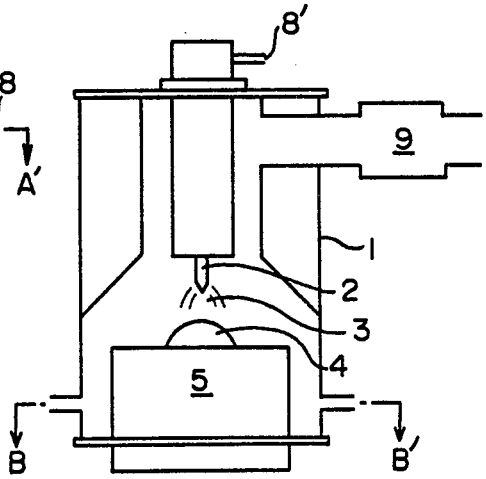
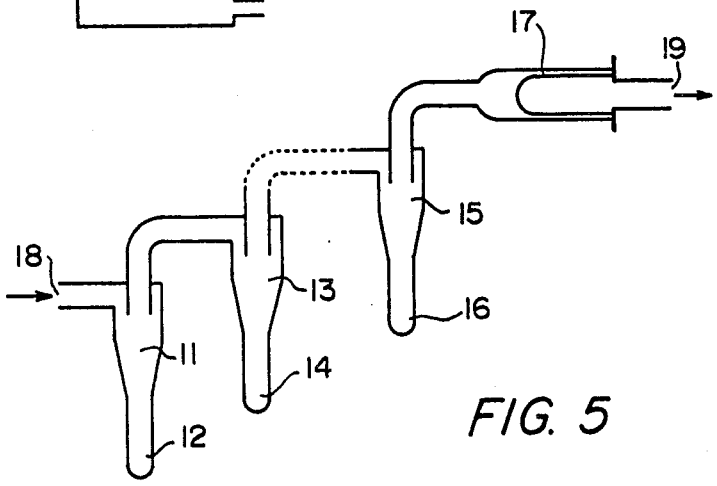
FIG. 5

APPARATUS FOR PRODUCING FINE METAL PARTICLES

This invention relates to an apparatus for producing fine metal particles. More specifically, it relates to an apparatus for producing fine metal particles having a diameter of less than 5 microns by reacting a molten metal with hydrogen activated by an arc or plasma discharge, etc.

The present inventors previously invented a method for producing fine metal particles, which comprises reacting a molten metal or alloy (to be referred to simply as a molten metal) with hydrogen activated by an arc discharge, plasma discharge or infrared ray to dissolve the activated hydrogen in the molten metal, and releasing the dissolved hydrogen from the molten metal thereby generating fine metal particles (U.S. patent application Ser. No. 222,903 filed on Jan. 5, 1981, now U.S. Pat. No. 4,376,740).

This prior method is practiced by generating an arc discharge between a starting metal and an electrode located opposite thereto in an atmosphere of hydrogen and an inert gas introduced in a closed vessel. The arc discharge activates hydrogen in the atmosphere and melts the metal, and the activated hydrogen is reacted with the molten metal. The activated hydrogen dissolves in the molten metal and when the dissolution reaches supersaturation, the dissolved hydrogen is evolved from the molten metal. At this time, a part of the molten metal is released in the form of fine particles, and the fine metal particles are carried to a trap by a gas flow.

This method, however, have some disadvantages. Because some fine metal particles adhere to the inner wall of the vessel, the ratio of recovery of the fine metal particles is low. Furthermore, the resulting fine metal particles have a very broad particle size distribution of, for example, 0.05 to 5 μm, and therefore a sharp particle size distribution is difficult to obtain.

It is an object of this invention to overcome the disadvantages of the above method, and to improve it so as to produce fine metal particles of a narrow particle size distribution at a high recovery ratio.

The present inventors conducted investigations in order to achieve the above object, and found that the broad particle size distribution of the fine metal particles is due to their growth by the effect of heat irradiation from the arc discharge or the molten metal and heat transfer of the gas heated by the arc discharge, and that the adhesion of the fine metal particles to the inner wall of the vessel is due to the fact that gas heated by an arc, etc. is circulated by convection within the vessel and fine metal particles grow to larger particles than the original ones by this convection within the vessel. It has also been found that the growth of the fine metal particles and their adhesion to the vessel wall can be prevented by quickly moving away the generated fine metal particles from a heat source such as an arc and the molten metal by means of a rapid gas flows and that the fine metal particles in the gas can be trapped more effectively by using traps, such as a combination of a centrifugal trap and a filter-type trap, and collecting the fine metal particles there. These findings have led to the present invention.

According to this invention, there is provided an apparatus for producing a particulate metal or alloy having a sharp particle size distribution by the reaction of a molten metal or alloy with activated hydrogen, said apparatus comprising (1) a metal melting hearth for melting a starting metal or alloy placed thereon and supporting the molten metal or alloy, (2) a discharge electrode positioned above, and opposite to, the metal or alloy placed on the melting hearth, (3) a closed vessel for containing the melting hearth and the discharge electrode, (4) a gas inlet port in the wall of the closed vessel for introducing hydrogen or a hydrogen-containing gas into the vessel, (5) a suction duct for sucking a gas in the vicinity of the molten metal or alloy and withdrawing it out of the vessel, said duct extending into the vessel through the vessel wall and opening in the vicinity of the molten metal or alloy on the melting hearth, (6) a trap connected to the suction duct for collecting fine particles of the metal or alloy, and (7) a cooler for cooling the sucked gas provided in the suction duct at a position midway between the trap and the opening of the suction duct in the vicinity of the molten metal or alloy.

According to the apparatus of this invention, the fine metal particles, upon generation from the molten metal, are sucked by the suction duct and moved away rapidly from the vicinity of the electrode and the molten metal. Thereafter, these metal particles are rapidly cooled by the cooler without floating in the closed vessel. It is possible therefore to prevent both broadening of their particle size distribution caused by their growth, and their loss caused by adhesion to the vessel wall. As a result, fine metal particles having a small particle size and a sharp particle size distribution can be obtained at a high recovery ratio.

According to an alternative embodiment of the apparatus of the invention, the suction duct is not provided. Instead, the gas inlet port for hydrogen or a hydrogen-containing gas is provided in a portion of the wall of the vessel which is above the melting hearth at such an angle that hydrogen or the hydrogen-containing gas forms a turning flow moving downwardly from the top of the vessel; or it is provided in a portion of the wall of the vessel which is below the melting hearth at such an angle that hydrogen or the hydrogen-containing gas forms a turning flow moving upwardly from the bottom of the vessel. By this turning flow, the generated fine metal particles are rapidly moved away from the vicinity of the molten metal. The cooled fine metal particles are then collected by a trap connected to a gas outlet port (either directly or through a gas conducting passage) provided at a suitable position in the vessel wall.

When the turning gas flow moves downwardly from the top of the vessel, the bottom portion of the closed vessel may be formed in a funnel or sylindrical shape and the gas outlet port may be provided at the lower end of the funnel or sylindrically shaped bottom. When the turning gas flow moves upwardly from the bottom of the vessel, the top of the vessel may be formed in the shape of a spire (an inverted funnel shape) and the gas outlet port may be provided at the pointed end of the spire.

In another embodiment, a suction device may be provided at a suitable position downstream of the gas outlet port so that it performs the dual function of feeding and sucking the turning gas flow into and from the closed vessel.

The preferred embodiments of the apparatus of this invention are described below with reference to the accompanying drawings in which:

FIGS. 1 to 4 are schematic views showing the arrangement of the various parts of the apparatus of this invention;

and

FIG. 5 is a schematic view of the trap in the apparatus of this invention.

FIGS. 3 and 4 show an embodiment in which the turning flow of hydrogen or a hydrogen-containing gas is formed.

Figure 1:
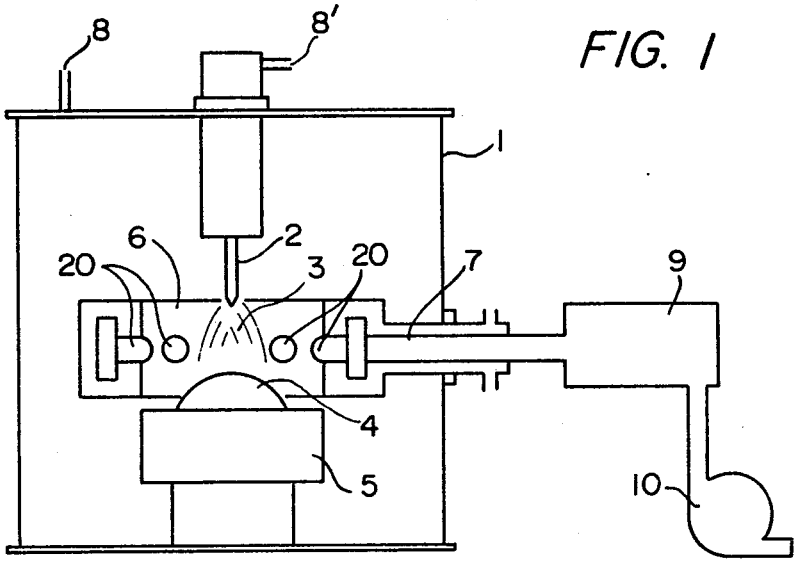
FIGS. 1 and 2 show an embodiment in which an opening portion is provided in the wall of the vessel.

With reference to FIG. 1, the closed vessel is shown at 1. Within the vessel, a voltage is applied across a discharge electrode 2 and a metal 4 by an arc discharge power supply (not shown) to generate an arc 3. This results in activation of the introduced hydrogen and melting of the metal. At this time, the activated hydrogen reacts with the molten metal, and dissolves in the molten metal. Fine metal particles are generated from the molten metal. They are entrained in a gas current introduced through a gas inlet 8 or 8' and are sucked by a suction duct 6 having an opening 20 in the vicinity of the molten metal and surrounding the molten metal, and carried to a cooler 7 where they are rapidly cooled. Then, the cooled fine metal particles are transferred to a trap 9 and collected. The reference numeral 10 represents a suction pump. The gas sucked by the suction pump 10 can be returned to the gas inlet 8 or 8' for reuse. The reference numeral 5 represents a metal melting hearth.

Figure 2:
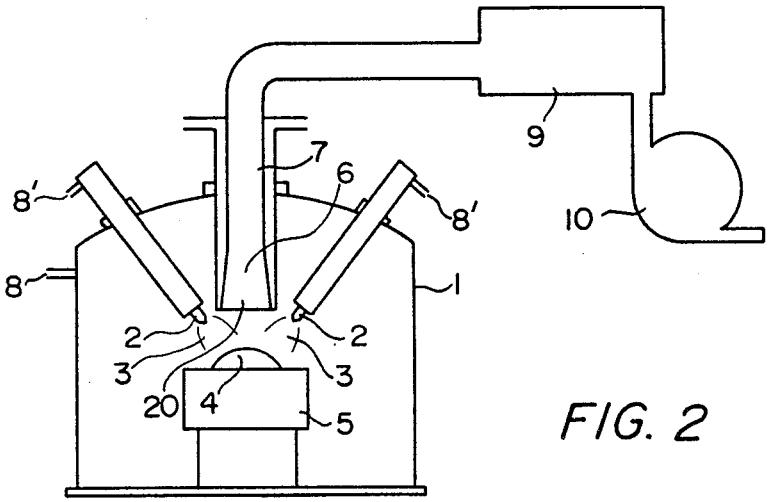

In the embodiment shown in FIG. 1, one discharge electrode 2 faces the metal 4 perpendicularly thereto. Alternatively, a plurality of electrodes 2,2 may be provided such that they face the metal 4 at an inclination to the vertical axis of the vessel, as shown in FIG. 2. In the embodiment of FIG. 2, the suction duct 6 is disposed such that the opening 20 for suction is located above the metal.

The embodiment of FIG. 2 is the same as that of FIG. 1 except that a plurality of discharge electrodes are inclinedly disposed and the suction opening is located above the metal.

FIG. 3 shows an example of the apparatus in which a suction duct opening in the vicinity of the molten metal is not used, and instead, fine metal particles generated from the molten metal are forcedly moved by a turning flow of hydrogen or a hydrogen-containing gas.

In the embodiment shown in FIG. 3, a vertical cylindrical closed vessel is used, and one or a plurality of gas inlets 8 are provided in the wall of the vessel in such a way that they open tangentially of the vessel wall. A cooler 7 is provided at the lower portion of the closed vessel 1. In this apparatus, fine metal particles generated from the molten metal are conveyed to the cooler 7 by a turning gas flow formed by jetting a gas from the gas inlet 8 and moving downwardly through the closed vessel 1. The gas flow containing the fine metal particles cooled in the cooler 7 are conducted to the trap 9 where the fine metal particles are collected. A suction pump (not shown) which is the same as in FIG. 1 may be provided at the exit of the trap 9.

FIG. 4 is a modification of the embodiment shown in FIG. 3. In FIG. 3, the gas inlet 8 opening tangentially of the vessel wall is provided on that part of the vessel wall which is above the metal 4, and the cooler 7 is provided below the metal 4. In contrast, in the embodiment of FIG. 4, the gas inlet 8 opens tangentially of the vessel wall at that part of the vessel wall which is below the metal, and the cooler 7 is provided above the metal. The introduced turning gas flow moves upwardly through the vessel. Otherwise, the embodiment of FIG. 4 is the same as that of FIG. 3.

FIG. 5 shows an example in which several cyclone traps, a kind of centrifugal trap, are aligned for use in this invention. Specifically, cyclone traps 11, 13 and 15 are provided in series. The gas current finally passes through a filter 17 and comes out from an outlet port 19. In this embodiment, the gas current containing fine metal particles cooled by a cooler (not shown) is introduced into the cyclone 11 from a gas current inlet 18. By the action of the cyclone 11, the fine metal particles are associated and partly collected by a trapping portion 12. Those fine metal particles which are not collected there are then successively collected by trapping portions 14 and 16 in the next cyclones 13 and 15. Finally, the gas is discharged from the outlet port 19 through the filter 17.

When the method of U.S. patent application Ser. No. 222,903, which comprises dissolving activated hydrogen in a molten metal, releasing the hydrogen, dissolved to supersaturation, from the molten metal to generate fine metal particles, and cooling and collecting them, is practiced by using the apparatus of this invention, the activated hydrogen denotes hydrogen or a nonoxidizable hydrogen-containing compound gas heated by an arc, plasma or infrared ray. Preferably, this gas is used as a mixture with an inert gas. The gas current for conveying the fine metal particles can be generated by jetting a gas into the closed vessel or sucking the gas from the inside of the closed vessel, or by performing both of these operations. The flow rate of the gas current is such that the fine metal particles are conveyed in the gas current without scattering. Preferably, it is at least 0.5 cm/sec. The gas current containing the fine metal particles can be cooled by passing it through a cooling means such as a water-cooled cooling tube. But other cooling means may also be used.

The fine metal particles can be collected from the cooled gas current, for example, by introducing the gas current into a centrifugal trap such as a cyclone to associate the metal particles, and further conducting the gas current into a filter-type trap such as a filter to collect those metal particles which have not been collected by the centrifugal trap. The centrigfugal trap may be comprised of a single unit or a plurality of units, preferably the latter.

By performing the method of producing fine metal particles disclosed in U.S. patent application Ser. No. 222,903 by using the apparatus of this invention, the particle size distribution of the produced fine metal particles can be controlled within a very narrow range, and the adhesion of the fine metal particles to the inner wall of the vessel, etc. can be prevented. Furthermore, since the metal particles are associated in the centrifugal trap and the fine metal particles can be effectively collected by a filter having a coarser size than the particle size, the fine metal particles can be collected with a markedly increased collecting efficiency. As a subsidiary effect of the present invention, contamination of the discharge electrode by fine metal particles floating and scattering in the closed vessel, and the suspension of the operation by blockage, can be markedly reduced, and therefore, the efficiency of producing fine metal particles can be increased.

The fine metal particles having a narrow particle size distribution obtained by this invention can be applied to magnetic recording media, electrically conductive paints, magnetic fluids, combustion accelerators, catalysts, cryogenic materials, superconducting materials, etc. and can greatly improve their properties.

The following Examples illustrate the present invention more specifically.

EXAMPLE 1

Fine metal particles were produced by using the apparatus shown in FIG. 1. Iron was used as a metal, and 50% $H_2$-Ar (total pressure 1 atmosphere) was used as a hydrogen-containing gas. The arc current was 200 A, and the arc voltage was 30 V. The cooler was a water-cooled cylindrical cooler having an inside diameter of 50 mm and a length of 200 mm, and the trap was a combination of 11 cyclone units and a cylindrical filter paper. The flow rate of the gas was 6.5 cm/sec.

For comparison, the above procedure was repeated except that the cooler and the trap were not used.

The results are shown below.

| | Particle size range (μm) | Recovery ratio (%) |
|---|---|---|
| Invention | 0.02–0.1 | 70–80 |
| Comparison | 0.05–5 | 20–30 |

EXAMPLE 2

Example 1 was repeated except that Fe-Ni alloy was used as the metal. The results were as follows:

| | Particle size range (μm) | Recovery ratio (%) |
|---|---|---|
| Invention | 0.02–0.08 | 70–80 |
| Comparison | 0.05–3 | 20–30 |

The results obtained in the above Examples demonstrate that according to the apparatus of this invention, the particle size distribution of the fine metal particles can be controlled to a very narrow range, and the efficiency of collecting the fine metal particles can be increased greatly.

What is claimed is:

1. An apparatus for producing a particulate metal or alloy having a diameter of less than 5 microns by the reaction of a molten metal or alloy with activated hydrogen, said apparatus comprising (1) a metal melting hearth for melting a starting metal or alloy placed thereon and supporting the resultant molten metal or alloy, (2) an arc generating electrode positioned above, and opposite to, the metal or alloy placed on the melting hearth, (3) a closed vessel for containing the melting hearth and the electrode, (4) a gas inlet port in the wall of the closed vessel for introducing hydrogen or a hydrogen-containing gas into the vessel, (5) a suction duct for sucking a gas in the vicinity of the molten metal or alloy and withdrawing it out of the vessel, said duct extending into the vessel through the vessel wall and opening adjacent the molten metal or alloy on the melting hearth, (6) a trap connected to the suction duct for collecting fine particles of the metal or alloy, and (7) a cooler for cooling the sucked gas provided in the suction duct at a position midway between the trap and the opening of the suction duct adjacent the molten metal or alloy.

2. The apparatus of claim 1 wherein the electrode is positioned immediately above the metal or alloy on the melting hearth.

3. The apparatus of claim 1 wherein a plurality of the electrodes are provided opposite to the metal or alloy on the melting hearth at an inclination to the vertical axis of the closed vessel.

4. The apparatus of claim 1 wherein the trap is a combination of a centrifugal trap and a filter-type trap.

5. An apparatus for producing a particulate metal or alloy having a diameter of less than 5 microns by the reaction of a molten metal or alloy with activated hydrogen, said apparatus comprising (1) a metal melting hearth for melting a starting metal or alloy placed thereon and supporting the resultant molten metal or alloy, (2) an arc generating electrode positioned above, and opposite to, the metal or alloy placed on the melting hearth, (3) a closed vessel for containing the melting hearth and the electrode, (4) a gas inlet port for introducing hydrogen or a hydrogen-containing gas into the vessel, said inlet port being provided either (a) in a portion of the wall of the vessel which is above the melting hearth at such an angle that the hydrogen or hydrogen-containing gas forms a turning flow moving downwardly from the top of the vessel, or (b) in a portion of the wall of the vessel which is below the melting hearth at such an angle that the hydrogen or hydrogen-containing gas forms a turning flow moving upwardly from the bottom of the vessel, (5) a gas outlet port for conducting the hydrogen or hydrogen-containing gas flow out of the vessel, said inlet and outlet ports cooperating to remove substantially all produced fine metal or alloy particles from the vessel through said outlet port, (6) a trap for collecting fine metal or alloy particles connected to said gas outlet port either directly or through a gas conducting passage, and (7) a gas cooler provided in a hydrogen or hydrogen-containing gas flow passage downstream of the melting hearth and upstream of the trap.

6. The apparatus of claim 5 wherein the electrode is positioned immediately above the metal or alloy on the melting hearth.

7. The apparatus of claim 5 wherein a plurality of the electrodes are provided opposite to the metal or alloy on the melting hearth at an inclination to the vertical axis of the closed vessel.

8. The apparatus of claim 5 wherein the trap is a combination of a centrifugal trap and a filter-type trap.

* * * * *